US008230628B2

(12) United States Patent
Recker et al.

(10) Patent No.: US 8,230,628 B2
(45) Date of Patent: Jul. 31, 2012

(54) APPARATUS AND METHOD FOR ATTACHING SIGNS TO CONCRETE ROAD BARRIERS

(75) Inventors: Michael J. Recker, Lithia, FL (US); Raymond R. Sullivan, Cincinnati, OH (US); Bernard J. Roman, Toledo, OH (US)

(73) Assignee: Meadow Burke, LLC, Tampa, FL (US)

( * ) Notice: Subject to any disclaimer, the term of this patent is extended or adjusted under 35 U.S.C. 154(b) by 90 days.

(21) Appl. No.: 12/751,097

(22) Filed: Mar. 31, 2010

(65) Prior Publication Data

US 2011/0214323 A1 Sep. 8, 2011

Related U.S. Application Data

(60) Provisional application No. 61/310,078, filed on Mar. 3, 2010.

(51) Int. Cl.
*G09F 7/18* (2006.01)

(52) U.S. Cl. ..... 40/606.14; 404/6; 404/9

(58) Field of Classification Search ..... 40/606.14, 40/611.06; 404/6, 9; 248/225.11, 298.1, 248/429, 226.11, 244, 312, 346.5, 612, 657, 248/480

See application file for complete search history.

(56) References Cited

U.S. PATENT DOCUMENTS 1,593,978 A * 7/1926 Langmuir ..... 206/9
3,720,746 A * 3/1973 Schwenk et al. ..... 264/219
4,224,002 A 9/1980 Heenan et al.
4,338,041 A 7/1982 Schmanski
4,773,629 A 9/1988 Yodock
4,946,306 A 8/1990 Yodock
4,954,009 A 9/1990 Kellison
5,015,119 A * 5/1991 Schmanski ..... 404/12
5,190,394 A * 3/1993 Mallon et al. ..... 404/6
5,224,791 A * 7/1993 Syak et al. ..... 404/9
5,244,172 A * 9/1993 Allega ..... 248/161
5,274,888 A * 1/1994 Payne ..... 24/277
5,419,134 A * 5/1995 Gibson ..... 40/611.05
5,788,405 A * 8/1998 Beard ..... 404/10
5,882,140 A 3/1999 Yodock, Jr. et al.
6,178,678 B1 * 1/2001 Stoddard ..... 40/618
6,224,290 B1 5/2001 Lavis
6,260,828 B1 * 7/2001 English ..... 256/24
6,505,994 B1 1/2003 Attar
6,835,023 B1 * 12/2004 Paterson ..... 404/6
6,840,707 B1 * 1/2005 Kulp et al. ..... 404/9
6,951,434 B2 * 10/2005 Yodock et al. ..... 404/6
6,976,660 B2 * 12/2005 Lapointe et al. ..... 248/218.4
7,014,389 B1 3/2006 Siblik
7,416,364 B2 * 8/2008 Yodock et al. ..... 404/6
7,621,691 B2 * 11/2009 Hannah ..... 404/7
7,922,420 B2 * 4/2011 Christensen et al. ..... 404/6
7,938,594 B1 * 5/2011 Schindler ..... 404/9

(Continued)

*Primary Examiner* — Lesley D. Morris
*Assistant Examiner* — Shin Kim
(74) *Attorney, Agent, or Firm* — Sheridan Ross PC

(57) ABSTRACT

A mounting arrangement for securing signs at select positions along the length of a concrete barrier is provided by forming a longitudinally extending groove within one side of the barrier and slideably positioning a bolt within the channel so that the bolt is captured within the channel for longitudinal movement relative thereto and extends through the groove and to the exterior of the barrier. The bolt extends through a sign support on the exterior of the barrier. A nut engaged with the bolt draws the sign support into secure engagement with the exterior surface of the barrier.

17 Claims, 5 Drawing Sheets

U.S. PATENT DOCUMENTS

| | | | | |
|---|---|---|---|---|
| 7,997,823 | B2 * | 8/2011 | Meyers | 404/6 |
| 8,020,822 | B2 * | 9/2011 | Goldin et al. | 248/250 |
| 2004/0146348 | A1 | 7/2004 | Tai | |
| 2005/0152744 | A1 | 7/2005 | Straub | |
| 2011/0099866 | A1 * | 5/2011 | Pitcher et al. | 40/611.01 |

* cited by examiner

APPARATUS AND METHOD FOR ATTACHING SIGNS TO CONCRETE ROAD BARRIERS

CROSS REFERENCE TO RELATED APPLICATION

This application claims priority to U.S. Provisional Patent Application No. 61/310,078, "Apparatus and Method for Attaching Signs to Concrete Road Barriers", filed Mar. 3, 2010, the contents of which are incorporated by reference it its entirety.

BACKGROUND OF THE INVENTION

The present invention relates to the attachment of reflectors and other signs to concrete road barriers. It is particularly addressed to an improved apparatus and method which provides for attachment at selectively variable positions along the length a temporary medium barrier, without drilling or the inclusion of permanently mounted hardware which would interfere with stacking or handling of the barriers.

A common way of currently attaching reflectors and signs to temporary medium barriers is to drill a hole into the top of the barrier and then insert an expansion anchor into the hole for securement of the sign or reflector. This is a relatively slow and labor intensive process.

It is also known to attach reflectors to temporary medium barriers through the use of adhesive, or recesses within the barriers. Such arrangements may be seen in U.S. Pat. Nos. 4,224,002; 6,224,290; 6,505,994 and Patent Application Publication U.S. 2004/0146348.

Another technique for securing reflectors to waterfilled plastic road barriers is to provide blind hole recesses in the top surface of the barriers, for the receipt of reflector supports. An example of such an arrangement may be seen in U.S. Pat. No. 4,946,306.

It is also known to attach glarefoils to road barriers through means of an elongated base runner secured to the top of the barrier, to which the glardshields are bolted. Such an arrangement may be seen in U.S. Pat. No. 4,338,041.

SUMMARY OF THE INVENTION

The apparatus of the present invention provides for the securing of reflectors and signs along the length of a concrete barrier through means of a slot formed in an opening through one side of the barrier. A sign support is slideably engaged with the barrier and has an opening aligned with the slot. A bolt is captured within the slot for slideable movement and extends therefrom through the opening in the sign support. A nut is engaged with the bolt to draw the sign support against the barrier. The method of the invention comprises forming the slot longitudinally within the barrier, slideably disposing the bolt within the slot for longitudinal movement while capturing the head of the bolt within the slot, positioning the sign support on the barrier and drawing the sign support against one side of the barrier to secure it in place.

A principal object of the invention is to provide an apparatus a method for securing signs and reflectors at selectively variable positions along the length of a temporary medium barrier, without the necessary of drilling or providing individual recesses for each sign or reflector.

Another object of the invention is to provide such a method and apparatus which may be incorporated into the barrier, without protruding elements which extend from the barrier when it is in the storage mode.

A further object related to the latter object is to provide a reusable mounting structure which does not interfere with stackability of the barriers when not in use.

Yet another object of the invention is to provide an apparatus which may be easily precast into a concrete barrier, without materially altering the shape of the barrier or creating obstacles which would interfere with the handling or stackability of the barrier.

Still another and more specific object of the invention is to provide an apparatus and method for mounting signs and reflectors at select locations along the length of a concrete barrier, which avoids to the need for drilling into the barrier and a risk of drilling into reinforcing steel.

These and other objects will become more apparent from the accompanying drawings in the following detailed description.

DESCRIPTION OF THE PREFERRED EMBODIMENT

Figure 1:
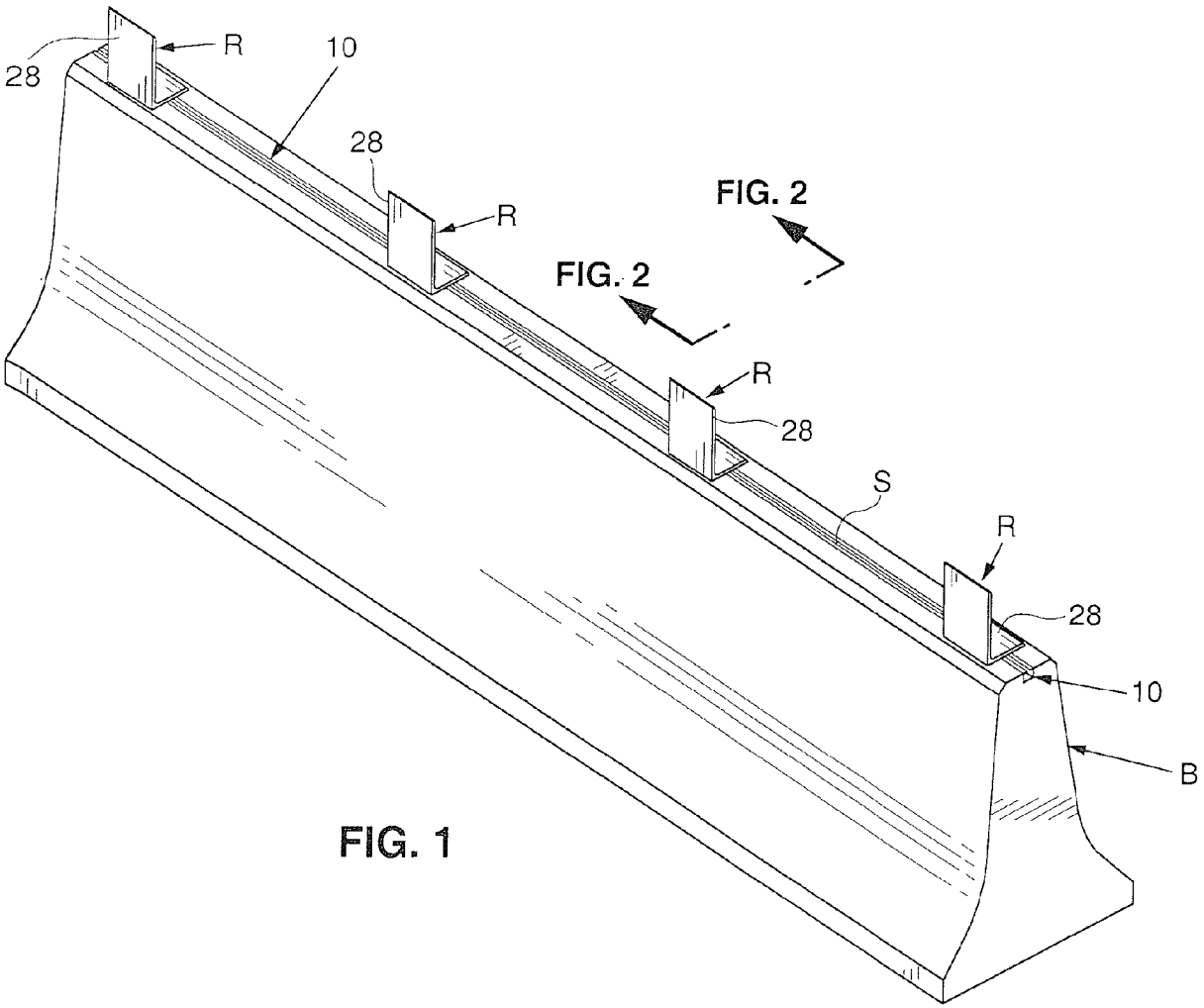
FIG. 1 is a perspective view of a concrete temporary medium barrier, with reflectors attached thereto through the mounting structure of the present invention.

Referring to FIG. 1, a precast concrete temporary road barrier B is shown having the slot S of the present invention formed in the top surface thereof. As shown in FIG. 1, the barrier B is an elongate and plurality of reflectors R are secured at select locations along its length by the connector of the invention.

Figure 2:
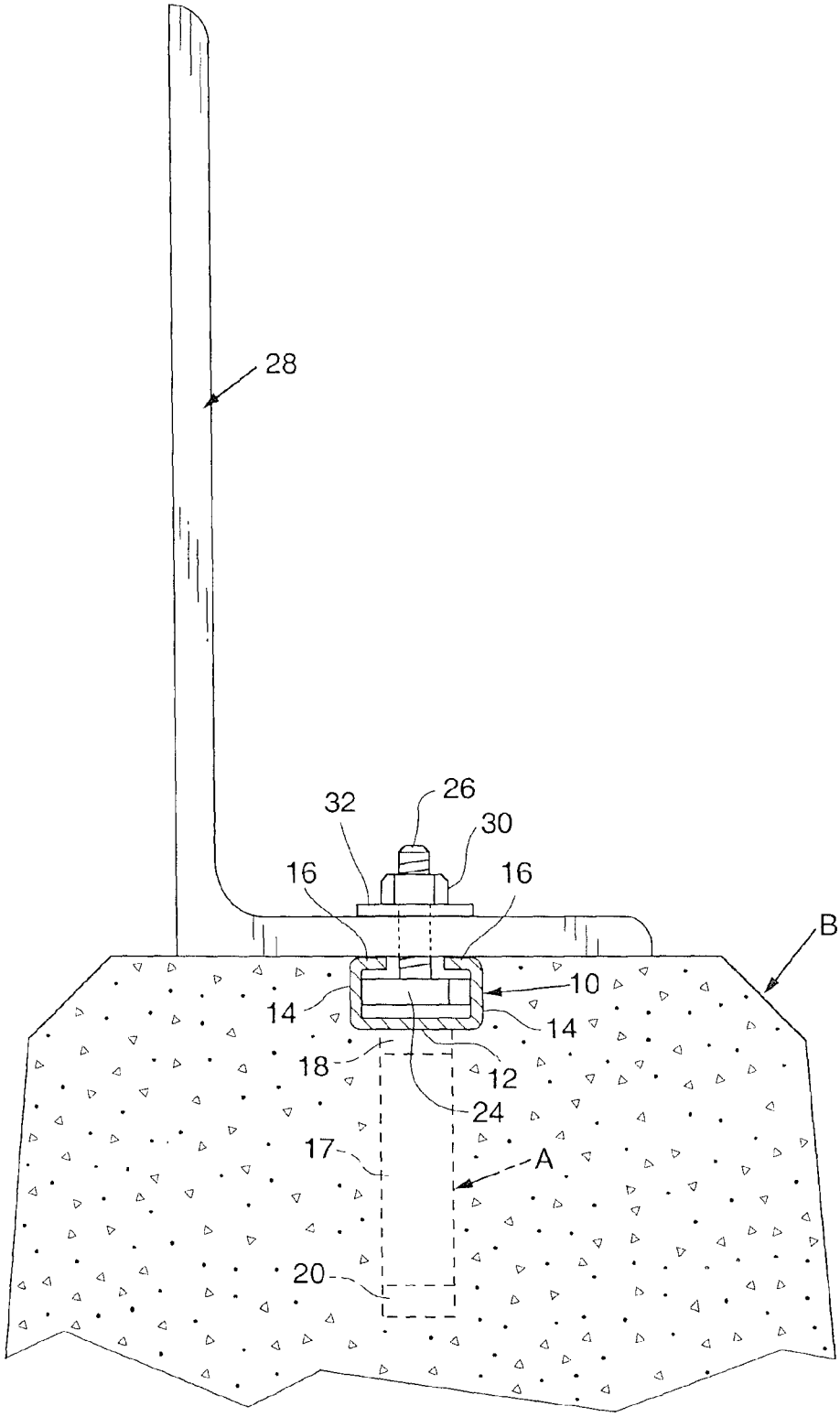
FIG. 2 is a cross-sectional view, taken on the plane designated by line 2-2 of FIG. 1.

The slot S is formed by a C-shaped channel 10 cast in place within the barrier, as can best be seen from FIG. 2. The channel is elongate and comprises a bottom wall 12; spaced sidewalls 14 extending upwardly from the bottom wall; and inwardly extending flanges 16 extending toward one another in spaced relationship to define the slot S therebetween.

Figure 3:
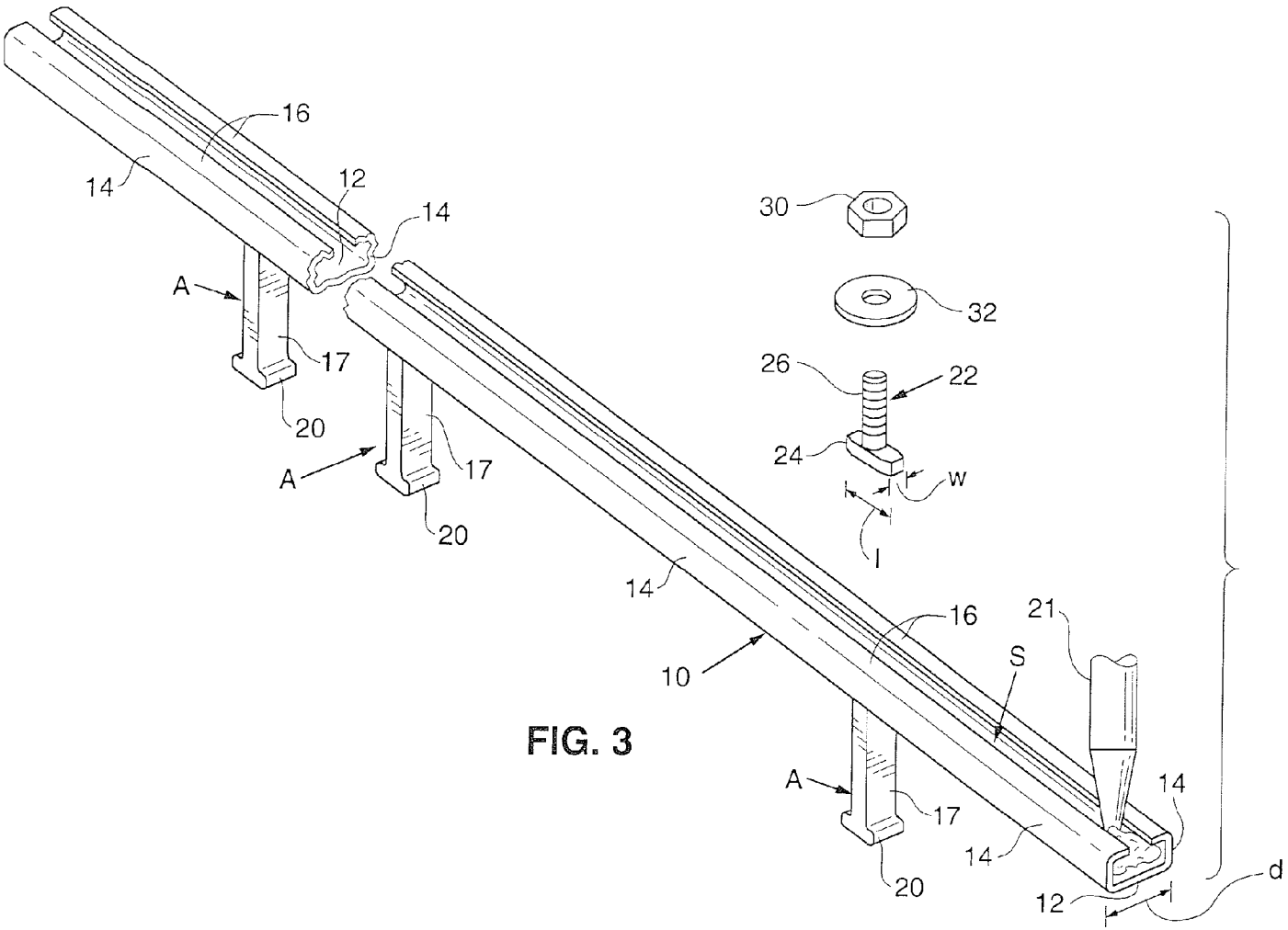
FIG. 3 is an exploded perspective view of the mounting structure of the present invention, with parts thereof broken away, showing the mounting channel and connecting bolt structure, separate and apart from the concrete barrier.
Figure 4:
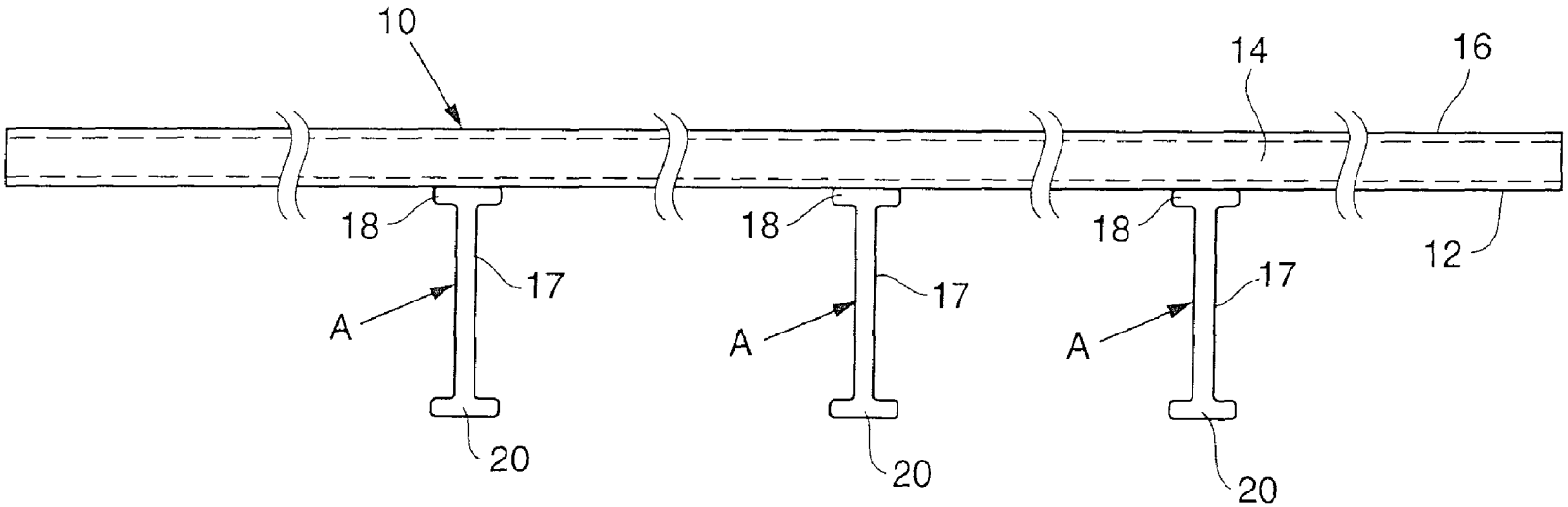
FIG. 4 is a side elevational view of the mounting channel shown in FIG. 3, with parts thereof broken away to accommodate the length of the channel.
Figure 5:
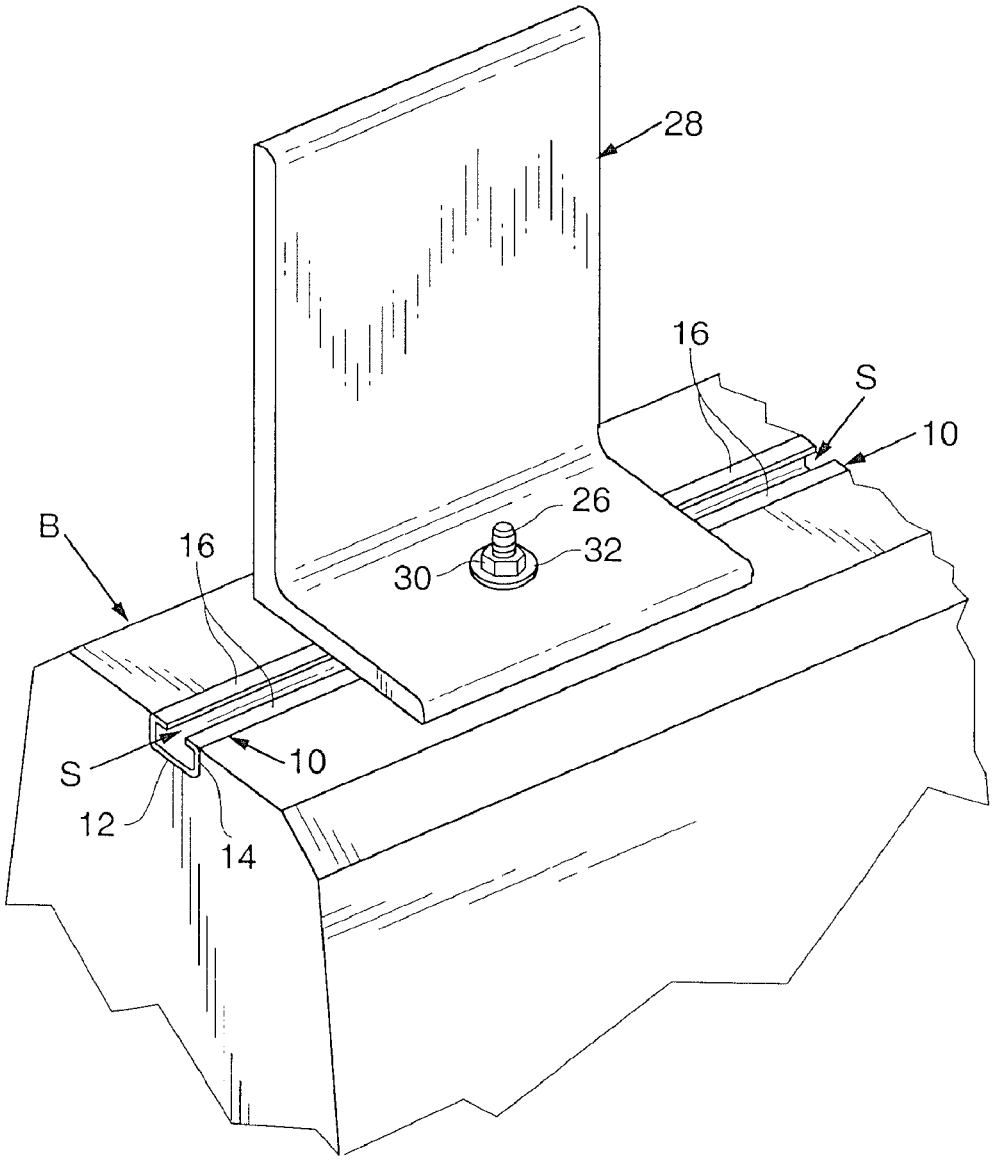
FIG. 5 is a perspective view, with parts thereof broken away, showing a reflector secured to the top of a concrete barrier through means of the structure of the present invention.

Anchor elements or legs A are fixed to and extend downwardly from the channel 10 at longitudinally spaced intervals (See FIGS. 3 and 4). These elements serve to secure the channel in place within the concrete barrier. As viewed from the side, the anchor elements are of an I-shaped configuration and each comprise a web 17, a head 18 welded to the channel 10, and an enlargement or foot 20.

FIG. 3 shows a foam applicator tube 21 which may be used to inject memory foam into the slot S to prevent the intrusion of concrete into the slot during formation of the barrier. Such foam is soft and crushable and does not interfere with the insertion of bolts into the slot. It also serves to prevent debris, water and ice accumulation during use of the barrier.

The channel 10 is cast in place within a concrete barrier so as to extend longitudinally of the barrier, with the anchors A embedded within the concrete of the barrier and the top surfaces of the flanges 16 flush with the top of the barrier (See FIG. 2). Bolts 22 are slideably received within the channel C and provide the means whereby signs and reflectors may be secured to the barrier B through the channel. Each bolt comprises an elongate head 24 proportioned for slideable receipt within the channel 10 and a threaded shank 26 of a cross-section permitting it to pass freely through the slot defined between the flanges 16 of the channel. The head 24 has a width dimension "w" permitting it to pass freely between the edges of the inwardly directed flanges 16 and a length dimension "l" enabling the head to be trapped beneath the inwardly directed flanges upon turning of a bolt 22 while the head is disposed within the channel. The oppositely disposed interior surfaces of the sidewalls 14 are spaced by a dimension "d" greater than the width dimension "w" and less than the length dimension "l". As a result, when the bolt 22 is turned about the axis of the shank 26, the edges of the head 24 engage the interior surfaces of the sidewalls 14 to limit rotation of the bolt and secure the head 24 beneath the flanges 16.

In use, the bolts 22 may be slid into place through the open ends of the C-shaped channel 10 or aligned and inserted in place through the slot between the flanges 16. A reflector or sign support 10 is then engaged with each of the bolts. Engagement is provided by extending the shanks of the bolts through apertures therefor in the supports and then securing each bolt to the support by a nut 30 and washer 32. With the nut and washer in place, the supports may be slid along the top of the barrier and, once in place at a selected location, secured by tightening the nut 30. Tightening functions both to turn the bolt so that the head 24 is captured beneath the flanges 16 and to draw the support against the top of the barrier B.

When it is desired to remove the supports 28, the nuts 30 need simply be loosened to enable the bolts to be either slid out of the ends of the channel 10, or drawn through the slot defined between the flanges 16. With the supports so removed, the barriers are conditioned for storage and reuse, with no parts of the sign fastening structure extending therefrom to interfere with handling or stacking.

The steps of the inventive method comprise:

a) forming a slot longitudinally within an elongate concrete barrier by casting the channel 10 within the barrier so that the space between the flanges 16 defines a slot within the barrier;

b) sliding a bolt 22 into the slot so that the head 24 is captured within the slot and the shank 26 extends from the slot;

c) positioning a support 24 on the barrier so that the shank of the bolt extends through an aperture therefor in the support;

d) sliding the support to any desired position along the length of the barrier; and e) engaging the shank of the bolt with a nut 30 to draw the support against the barrier.

An additional step is to inject foam into the channel. This may be done prior to casting of the channel within barrier to prevent the intrusion of concrete into the channel during the casting process. Foam may also be injected into the channel after formation of the barrier to prevent debris, water and ice intrusion during use of the barrier.

Conclusion

While a preferred embodiment of the invention has been illustrated and described, the invention is not intended to be limited to the specifics of that embodiment, but rather is defined by the following claims.

The invention claimed is:

1. A precast concrete road barrier and apparatus for selectively securing signs thereto, said precast concrete road barrier comprising:

a. a recessed channel cast in place within and extending lengthwise of said precast barrier, said recessed channel providing a continuous slot extending longitudinally of the barrier and bounded by spaced inwardly extending flanges;

b. a bolt received within the channel, said bolt having a head slideably received within the channel for selective interior engagement with the inwardly extending flanges and a shank extending from the head and through the slot; and, c. a nut engaged with the shank on the exterior of the channel to selectively draw the head into secure engagement with the inwardly extending flanges at selectively variable positions along a length of said continuous slot.

2. An apparatus according to claim 1, wherein:

a. the shank is of a cross-section permitting it to slide freely between the inwardly extending flanges;

b. the head has a width dimension permitting it to be aligned with and freely pass between the inwardly extending flanges and a length dimension enabling the head to be trapped inwardly of the flanges upon turning of the bolt while within the channel.

3. An apparatus according to claim 2, wherein the channel has oppositely disposed longitudinally extending interior walls spaced by a dimension greater than the width dimension of the head and less than the length dimension of the head.

4. An apparatus according to claim 1, wherein:

a. the channel is embedded within the barrier; and, b. the slot opens through one side of the barrier.

5. An apparatus according to claim 4, wherein:

a. the shank is of a cross-section permitting it to slide freely between the inwardly extending flanges; and, b. the head has width dimension permitting it to be aligned with and freely pass between the inwardly extending flanges and a length dimension enabling the head to be trapped inwardly of the flanges upon turning of the bolt while within the channel.

6. An apparatus according to claim 5, wherein the channel has oppositely disposed longitudinally extending interior walls spaced by a dimension greater that the width dimension of the head and less than the length dimension of the head.

7. An apparatus according to claim 4, further comprising anchor elements secured to and extending from the channel for embedment within the barrier to resist pull-out of the channel from the barrier.

8. An apparatus according to claim 7 wherein the anchor elements comprise legs secured to and extending from the channel, said legs having enlargements extending laterally therefrom in spaced relationship to the channel.

9. A precast concrete road barrier and apparatus for selectively securing a sign at select positions along the length of the precast barrier, said apparatus comprising:

a. a longitudinally extending continuous recessed slot formed within the precast barrier and opening through one side thereof;

b. a sign support slideably engaged with said one side and having an opening therethrough aligned with the slot;

c. a bolt captured within the slot for longitudinal movement relative thereto and extending therefrom through the opening in the sign support; and, d. a nut engaged with the bolt to selectively draw the sign support against said one side and secure the support against longitudinal movement relative to the barrier.

10. Apparatus according to claim 9 wherein:

a. the slot is provided by a channel embedded within the barrier and opening through said one side of thereof;

b. the channel has oppositely disposed inwardly extending flanges which serve to capture the bolt within the slot.

11. An apparatus according to claim 10, wherein the bolt has a head with a width dimension permitting the head to be aligned with and freely pass between the inwardly extending flanges and a length dimension enabling the head to be trapped beneath the inwardly extending flanges upon turning of the bolt while within the channel.

12. Apparatus according to claim 11, wherein the channel has oppositely disposed longitudinally extending interior walls spaced by a dimension greater that the width dimension of the head and less than the length dimension of the head.

13. A method for securing a sign at select positions along the length of a precast concrete barrier, said method comprising:

a. forming a recessed slot longitudinally within and opening through at least one side of the precast barrier;

b. slideably disposing a bolt within the slot for longitudinal movement relative thereto, said bolt having a head captured within the slot and a shank extending through the slot;

c. positioning a sign support at a selectively variable position on said one side of the barrier, with the shank of the bolt extending though an aperture therefor in the support; and, d. engaging the shank of the bolt with a nut to draw the sign support against said one side and secure the support against longitudinal movement relative to the barrier.

14. A method according to claim 13, wherein:

a. the slot is formed with inwardly directed oppositely disposed flanges extending longitudinally of the barrier;

b. the head of the bolt is captured to the interior of the flanges and, c. the shank of the bolt extends between the flanges.

15. A method according to claim 14, wherein the head of the bolt is formed with a width dimension permitting it to be aligned with and pass freely between the inwardly directed flanges and a length dimension enabling the head to be trapped interiorly of the inwardly extending flanges upon turning of the bolt while within the channel.

16. A method according to claim 15 wherein the channel is formed with oppositely disposed longitudinally extending interior walls spaced by a dimension greater than the width dimension of the head and less than the length dimension of the head.

17. A method according to claim 13, further comprising the step of injecting foam plastic into the slot.

* * * * *